US007032810B2

(12) United States Patent
Benedetti et al.

(10) Patent No.: US 7,032,810 B2
(45) Date of Patent: Apr. 25, 2006

(54) SEALED PACKAGE FOR POURABLE FOOD PRODUCTS

(75) Inventors: Paolo Benedetti, Modena (IT); Sid Johari, Bjarred (SE)

(73) Assignee: Tetra Laval Holdings & Finance SA, Pully (CH)

( * ) Notice: Subject to any disclaimer, the term of this patent is extended or adjusted under 35 U.S.C. 154(b) by 357 days.

(21) Appl. No.: 10/450,122

(22) PCT Filed: Dec. 11, 2001

(86) PCT No.: PCT/EP01/14553

§ 371 (c)(1),
(2), (4) Date: Oct. 9, 2003

(87) PCT Pub. No.: WO02/48001

PCT Pub. Date: Jun. 20, 2002

(65) Prior Publication Data

US 2004/0055918 A1 Mar. 25, 2004

(30) Foreign Application Priority Data

Dec. 12, 2000 (IT) ..... TO2000A1150

(51) Int. Cl.
*B65D 17/00* (2006.01)

(52) U.S. Cl. ..... 229/238; 229/125.15; 229/242; 383/205; 383/209

(58) Field of Classification Search ..... 229/115, 229/206, 125.15, 208, 238, 240, 242; 220/266, 220/270, 359.2, 359.3, 359.4; 383/205, 208, 383/209

See application file for complete search history.

(56) References Cited

U.S. PATENT DOCUMENTS

| | | | | | |
|---|---|---|---|---|---|
| 2,773,634 | A | * | 12/1956 | Negoro | 229/206 |
| 3,098,601 | A | * | 7/1963 | Anderson et al. | 383/205 |
| 3,305,159 | A | | 2/1967 | Becker et al. | |
| 3,613,986 | A | * | 10/1971 | Christensson | 229/208 |
| 3,619,395 | A | * | 11/1971 | Skendzic | 264/173.17 |
| 3,620,439 | A | * | 11/1971 | Morse et al. | 229/208 |
| 3,951,333 | A | * | 4/1976 | Forbes et al. | 229/206 |
| 4,372,460 | A | * | 2/1983 | Brochman et al. | 220/270 |
| 4,595,116 | A | * | 6/1986 | Carlsson | 220/359.3 |
| 4,705,197 | A | * | 11/1987 | Gordon et al. | 220/270 |
| 4,781,323 | A | * | 11/1988 | Elias et al. | 229/125.15 |
| 4,789,067 | A | * | 12/1988 | Silano | 229/249 |
| 4,792,069 | A | * | 12/1988 | Nantin et al. | 229/125.15 |
| 4,796,760 | A | * | 1/1989 | Rausing | 229/238 |
| 4,798,296 | A | * | 1/1989 | Lagerstedt et al. | 220/270 |
| 4,819,839 | A | * | 4/1989 | Carlsson et al. | 229/125.15 |
| 4,838,429 | A | * | 6/1989 | Fabisiewicz et al. | 383/205 |
| 4,927,028 | A | | 5/1990 | Hemm et al. | |

(Continued)

FOREIGN PATENT DOCUMENTS

DE 1208681 1/1966

(Continued)

*Primary Examiner*—Gary E. Elkins
(74) *Attorney, Agent, or Firm*—Buchanan Ingersoll

(57) ABSTRACT

There is described a sealed package (1, 15) for pourable food products, formed from a multilayer packaging material (2, 16) and having an opening (10, 26) closed, on the inside of the package (1, 15), by a sheet element (11, 27), and a removable opening tab (12, 28) joined to the sheet element (11, 27) and covering the opening (10, 26) on the outside of the package (1, 15); the opening (10, 26) extending close to the end portion (8,17) of the package (1,15) and along at least half the perimeter of the package (1, 15).

11 Claims, 2 Drawing Sheets

U.S. PATENT DOCUMENTS 5,125,529 A * 6/1992 Torterotot ..... 220/270
5,452,849 A * 9/1995 Schramer et al. ..... 229/206
5,632,440 A * 5/1997 Tragardh et al. ..... 229/125.15
5,653,383 A * 8/1997 Adachi et al. ..... 229/125.15
5,836,697 A 11/1998 Chiesa
5,855,435 A * 1/1999 Chiesa ..... 383/209
6,036,803 A * 3/2000 Lasson et al. ..... 156/216
6,419,152 B1 * 7/2002 Tokarski ..... 229/242

FOREIGN PATENT DOCUMENTS

WO WO/9701495 1/1997

* cited by examiner

SEALED PACKAGE FOR POURABLE FOOD PRODUCTS

FIELD OF THE INVENTION

The present invention relates to a perfected sealed package for pourable food products.

BACKGROUND OF THE INVENTION

Many pourable food products, such as fruit juice, pasteurized or UHT (ultra-high-temperature processed) milk, wine, tomato sauce, etc., are sold in packages made of sterilized packaging material.

A typical example of such a package is the parallelepiped-shaped package for liquid or pourable food products known as TETRA BRIK ASEPTIC (registered trademark), which is formed by folding and sealing laminated strip packaging material. The laminated packaging material comprises layers of fibrous material, e.g. paper, covered on both sides with thermoplastic plastic material, e.g. polyethylene, and, in the case of aseptic packages for long-storage products, such as UHT milk, the side of the packaging material eventually contacting the food product in the package also has a layer of oxygen-barrier material, e.g. a sheet of aluminium or EVOH, which is in turn covered with one or more layers of thermoplastic material.

As is known, such packages are formed on fully automatic packaging machines, on which a continuous tube is formed from the web-fed packaging material; the web of packaging material is sterilized on the packaging machine itself, e.g. by applying a chemical sterilizing agent, such as a hydrogen peroxide solution, which, after sterilization, is removed, e.g. vaporized by heating, from the surfaces of the packaging material; and the web of packaging material so sterilized is maintained in a closed sterile environment, and is folded and sealed longitudinally to form a tube.

The tube is filled with the sterilized or sterile—processed food product, and is sealed and cut at equally spaced cross sections to form pillow packs, which are then folded mechanically to form the finished, e.g. substantially parallelepiped-shaped, packages.

The finished package is provided with an opening device normally defined by a removable opening tab, which is applied to the packaging material before this is fed to the packaging machine where, as stated, it is folded to form a continuous tube and filled with the food product for packaging.

More specifically, the first operation comprises forming an orifice or through hole in the packaging material; the side of the packaging material eventually forming the inside of the package is then fitted with a "patch" over the hole and comprising a small sheet of heat-seal plastic material; and the opposite side of the packaging material is fitted with the removable opening tab, which is heat sealed to the patch. On the side heat sealed to the patch, the tab normally comprises a layer of heat-seal plastic material, e.g. polyethylene. By virtue of the patch and tab adhering to each other, the tab, when pulled off, also removes the part of the patch sealed to it, thus opening the hole.

Alternatively, the through hole may be formed directly in the layer of fibrous material of the packaging material, before the fibrous material layer is laminated with the other packaging material layers hereinafter referred to simply as "lamination layers".

At the end of the lamination process, the hole is thus covered by the lamination layers, the package is perfectly sound, and a patch is no longer required.

As before, the tab is applied to the side of the packaging material eventually defining the outside of the package, and is sealed to the layer of thermoplastic material covering the hole.

Wedge-shaped sealed packages for pourable food products are also known by the name of TETRA WEDGE (registered trademark), which are also formed from a tube of sheet packaging material sealed and cut along equally spaced cross sections as described above.

Such packages are defined by a flat rectangular base wall; by two isosceles-trapezium-shaped lateral walls projecting from respective opposite sides of the base wall; and by two triangular lateral walls projecting from the other sides of the base wall and forming, with the trapezoidal lateral walls, a wedge-shaped end portion opposite the base wall and including a transverse sealing band of the package.

Wedge-shaped packages of the above type normally have no opening devices, and are widely used in markets in which cost is the main parameter.

On account of the small size of the product outlet hole or the absence of an opening device, such packages are unsuitable for use with highly viscous, semifluid pourable food products, such as yoghurt, cream or soup, or with solidified pourable food products, such as cheese or desserts, which are poured into the package in liquid form and later set inside the package. Such packages, in fact, make it extremely difficult to extract the above products from the outlet holes or from openings torn or cut into the packages, and, above all, do not permit insertion of a spoon by which to scoop out the product.

SUMMARY OF THE INVENTION

It is an object of the present invention to provide a sealed package for pourable food products, designed to eliminate the aforementioned drawback typically associated with known packages.

According to the present invention, there is provided a sealed package for pourable food products, formed from a multilayer packaging material; said package having an opening closed, on the inside of the package, by a sheet element; and a removable opening tab joined to said sheet element and covering said opening on the outside of said package; characterized in that said opening extends close to an end portion of said package and along at least half the perimeter of the package.

BRIEF DESCRIPTION OF THE DRAWINGS

Two preferred, non-limiting embodiments of the present invention will be described by way of example with reference to the accompanying drawings, in which.

DETAILED DESCRIPTION OF THE INVENTION

Figure 1:
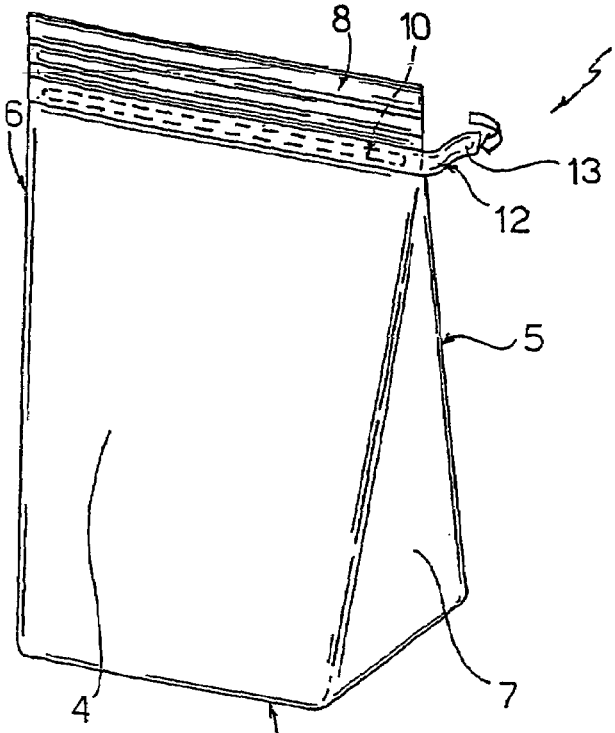
FIG. 1 shows a front-side view in perspective, at an initial opening stage by the user, of a sealed package for pourable food products in accordance with the present invention.
Figure 2:
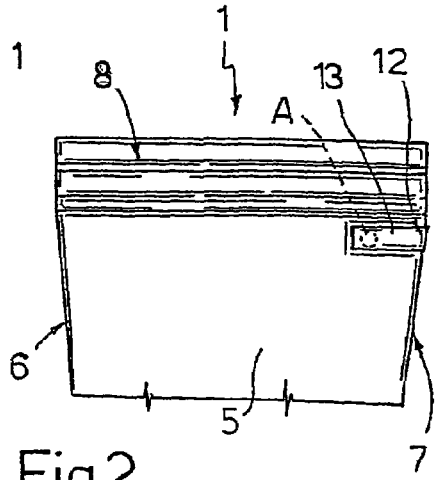
FIG. 2 shows a rear view of a top portion of the FIG. 1 package when closed.

Number 1 in FIGS. 1 and 2 indicates as a whole a sealed package for pourable food products in accordance with the present invention.

Package 1 is formed from a tube of sheet packaging material sealed and cut along equally spaced cross sections, as described in detail previously.

Figure 3:
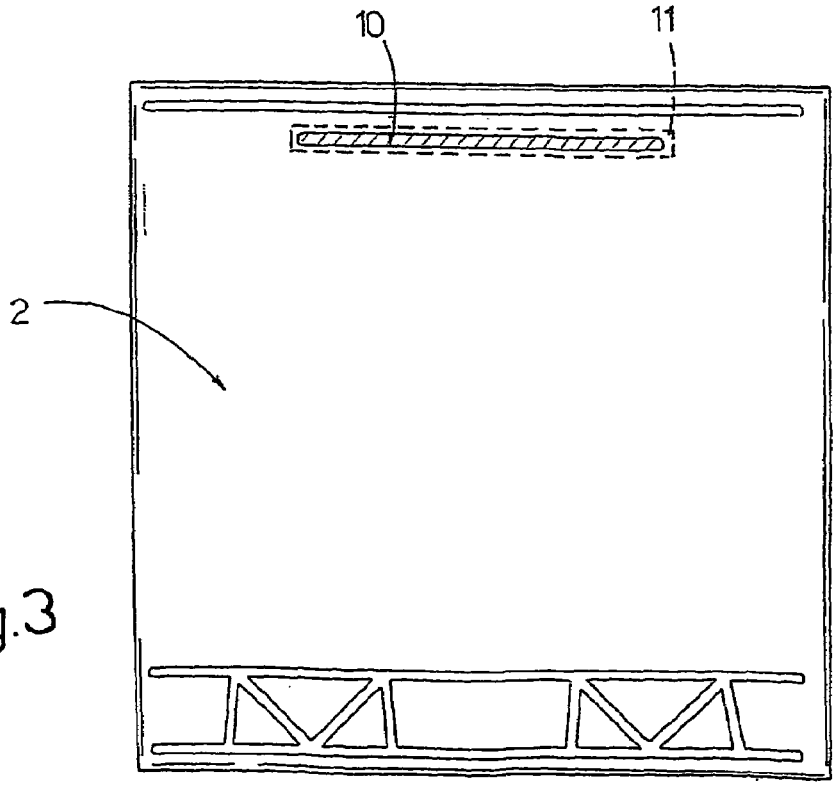
FIG. 3 shows a plan view of a portion of a packaging material web from which to form the FIG. 1 package.

The packaging material, of which FIG. 3 shows a portion 2 from which package 1 is formed, has a multilayer structure (not shown).

When used for packaging pasteurized products (e.g. yoghurt, cream and other cold-storage products), the packaging material substantially comprises a layer of fibrous material, normally paper, covered on both sides with respective layers of thermoplastic material, e.g. polyethylene. Alternatively, and particularly when package 1 is exposed, in use, to exceptional humidity or to direct contact with water, the packaging material comprises, instead of the fibrous material layer, a layer of propylene, in turn including a mineral inorganic filler.

In the case of aseptic packages for long-storage products, such as UHT milk, the side of the packaging material eventually contacting the food product in package 1 also has a layer of oxygen-barrier material, e.g. EVOH, which is in turn covered with one or more layers of thermoplastic material, e.g. polyethylene.

By virtue of the packaging material structure described above, package 1 may advantageously be inserted in a microwave oven to heat the product inside the package.

Alternatively, the barrier material layer of the packaging material may be made of aluminium; in which case, the resulting packaging material cannot be used for products heatable in a microwave oven.

Package 1 is substantially wedge-shaped, and is defined by a flat rectangular base wall 3; by two isosceles-trapezium-shaped lateral walls 4, 5 projecting from respective opposite sides of, and tapering towards, base wall 3; and by two isosceles-triangle-shaped lateral walls 6, 7 projecting from the other sides of base wall 3 and forming, with lateral walls 4 and 5, a wedge-shaped end portion 8 opposite base wall 3.

Package 1 comprises a longitudinal sealing band (not shown in FIGS. 1 and 2) extending vertically along lateral wall 5; and two transverse sealing bands, one defining wedge-shaped end portion 8, and the other (not shown in FIG. 1) folded in known manner on to base wall 3.

An important aspect of the present invention is that package 1 also comprises a through opening 10 (FIGS. 1 and 3) formed close to wedge-shaped end portion 8 and extending substantially along half the perimeter of package 1. More specifically, opening 10 is closed, on the inside of package 1, by a patch 11 of heat-seal sheet material, and, on the outside of package 1, by a removable opening tab 12 sealed to patch 11.

As shown in FIGS. 1 and 3, opening 10 is elongated in a direction parallel to wedge-shaped end portion 8, and extends horizontally along the whole width of lateral wall 4.

Opening 10 is narrower than it is long, and is of a width of a few mm.

With particular reference to FIG. 3, patch 11 is comparable in size to that of opening 10, and is heat sealed to the packaging material of package 1 about opening 10.

More specifically, patch 11 is defined by a layer of oxygen-barrier material, preferably EVOH, covered on both sides with respective layers of thermoplastic material, e.g. polyethylene.

With reference to FIGS. 1 and 2, tab 12 is strip-shaped, is made of heat-seal laminated material, and is heat sealed to patch 11 along a sealing area extending close to and within a lateral edge of opening 10, and defining a tear-off portion of and for tearing patch 11 as tab 12 is removed.

More specifically, tab 12 projects outwards with respect to the lateral edge of opening 10, and comprises, at one end of opening 10, an end portion 13 detached from patch 11, defining a grip portion by which to tear open package 1, and sealed at a point A (FIG. 2) to the outer surface of lateral wall 5, so as not to interfere with parts of the packaging machine when forming, filling and sealing package 1.

Tab 12 also has a multilayer structure, and comprises, in the example shown, a layer of PET covered, at least on the side eventually sealed to patch 11, with a layer of adhesion-promoting material ("primer"), and with a layer of thermoplastic material, e.g. polyethylene.

The material of tab 12 may be colored to prevent light rays from penetrating package 1.

In actual use, package 1 is opened by detaching grip portion 13 of tab 12 from wall 5 and pulling it along the perimeter of package 1, so as to tear off the part of patch 11 sealed to tab 12, and so free opening 10.

By virtue of the length of opening 10, wedge-shaped end portion 8 is detached completely from lateral wall 4, and the open package 1 assumes a substantially truncated-cone shape enabling the food product to be poured or spooned out easily.

Figure 6:
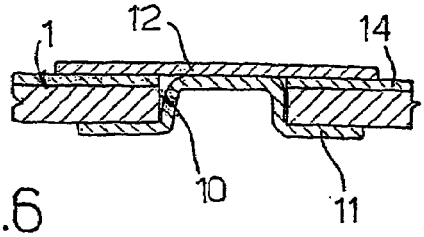
FIG. 6 shows a larger-scale section of a variation of the packaging material defining the opening region of the FIG. 1 and 2 package.

In the FIG. 6 variation, at opening 10, the packaging material of package 1 may be covered on the outside with a sheet element 14 of thermoplastic material, to which the peripheral portion of tab 12 is then heat sealed.

More specifically, sheet element 14 is slightly larger than opening 10, and is heat sealed to the packaging material, from which package 1 is eventually formed, before the material is pierced to form opening 10, so that the pierced opening 10 extends through both the packaging material and sheet element 14.

Sheet element 14 is preferably defined by a layer of polyethylene, which adheres to the outside of the packaging material of package 1, and by a layer of polypropylene to which tab 12 is applied. More specifically, in the course of the heat-seal operation, tab 12 is sealed to patch 11 at opening 10, and peripherally to sheet element 14.

As is known, polypropylene and polyethylene adhere less firmly to each other than to tab 12 and, respectively, the outer polyethylene layer of the packaging material of package 1, so that, when package 1 is opened, the polypropylene layer of sheet element 14 remains attached to and is removed together with tab 12, while the polyethylene layer remains attached to package 1, thus preventing tab 12, when pulled off, from "stripping" the packaging material of package 1 and leaving annoying fragments of material in the area of opening 10.

Figure 4:
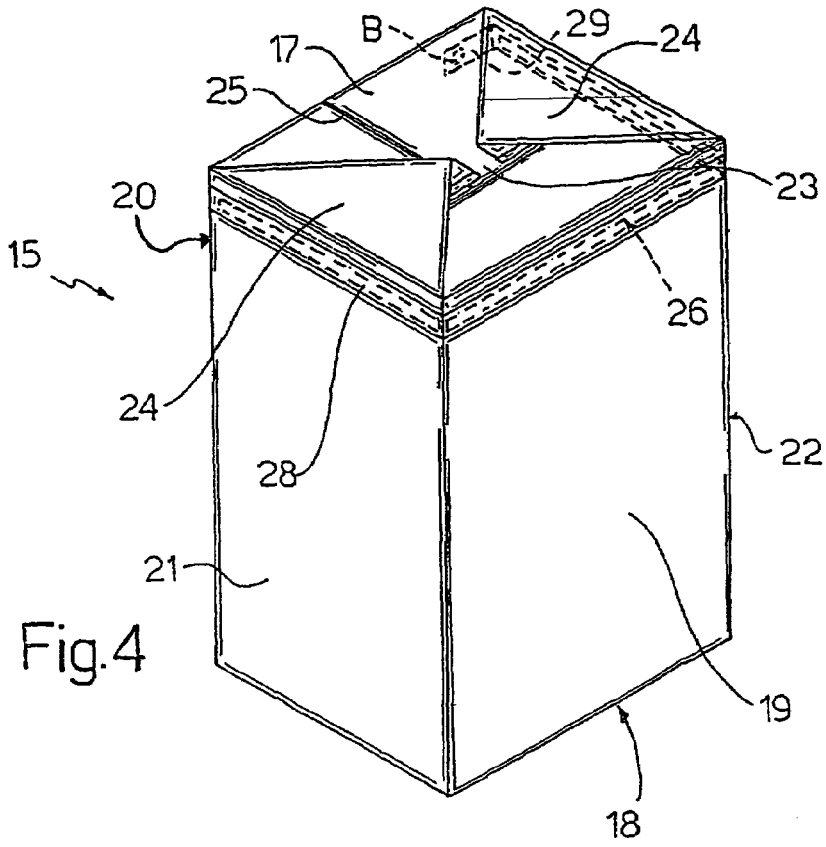
FIG. 4 shows a view in perspective of a sealed package for pourable food products in accordance with a further embodiment of the present invention.

Number 15 in FIG. 4 indicates as a whole a sealed package for pourable food products in accordance with a further embodiment of the present invention, and any parts of which identical with or corresponding to parts of package 1 already described are indicated wherever possible using the same reference numbers.

Figure 5:
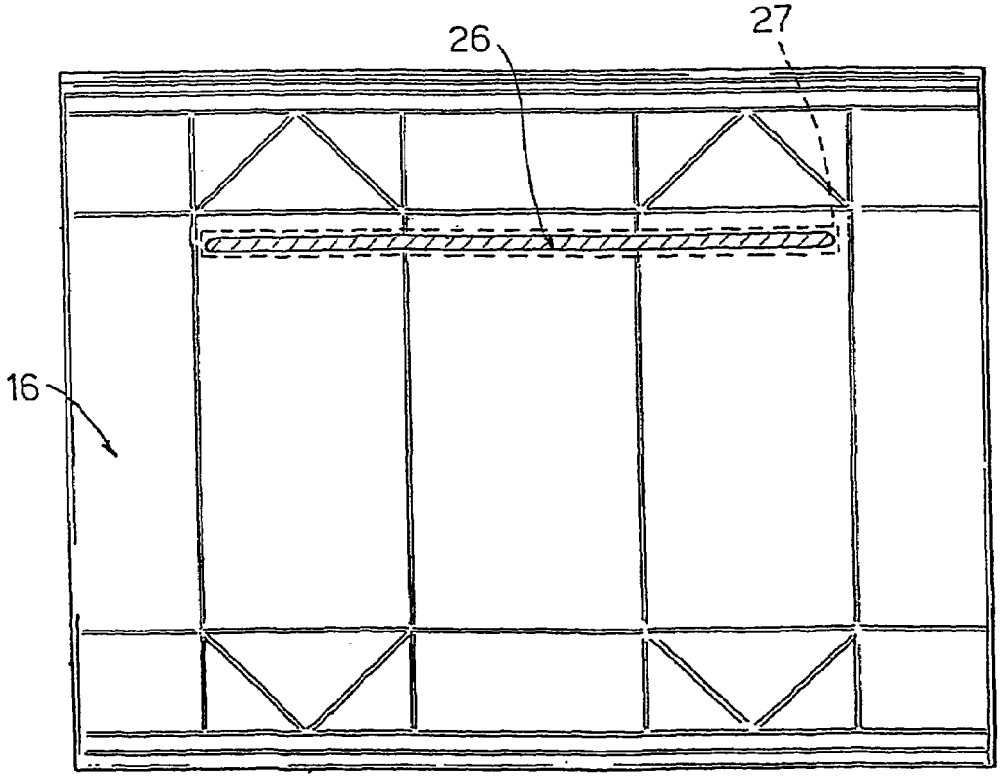
FIG. 5 shows a plan view of a portion of a packaging material web from which to form the FIG. 4 package.

Package 15 is in the form of a substantially parallelepiped-shaped box, and is made from a multilayer packaging material of the same type as package 1, and of which FIG. 5 shows a portion 16 from which package 15 is formed.

Package 15 is defined by two opposite, respectively top and bottom, end walls 17, 18; and by four lateral walls 19, 20, 21, 22 facing in pairs and extending perpendicularly between end walls 17, 18.

Like package 1, package 15 comprises two transverse sealing bands 23 (only one shown in FIG. 4) extending across respective end walls 17, 18 and parallel to opposite lateral walls 19, 20. Each transverse sealing band 23 extends beyond respective end wall 17, 18 at both lateral walls 21, 22, and defines, with lateral walls 21, 22, respective substantially flat, triangular lateral flaps 24 of packaging material, which are folded on to and coplanar with respective end wall 17, 18.

Package 15 also comprises a longitudinal sealing band 25 extending vertically along lateral wall 20 and along end walls 17, 18 up to respective transverse sealing bands 23.

In exactly the same way as package 1, package 15 comprises a through opening 26 formed just below end wall 17 and extending along the perimeter of package 15 at consecutive lateral walls 19, 21 and 22. Opening 26 is closed, on the inside of package 15, by a patch 27 of sheet material, similar to patch 11, and, on the outside of package 15, by a removable opening tab 28, also similar to tab 12 and sealed to patch 27.

At each lateral wall 19, 21, 22, opening 26 extends parallel to the respective edge defined between lateral wall 19, 21, 22 and end wall 17, and is narrower than it is long and of a width of a few mm.

With particular reference to FIG. 5, patch 27 is comparable in size to that of opening 26, and is heat sealed to the packaging material of package 15 about opening 26.

With reference to FIG. 4, tab 28 is heat sealed to patch 27 along a sealing area extending close to and within a lateral edge of opening 26, and defining a tear-off portion of and for tearing patch 27 as tab 28 is removed.

In this case, too, tab 28 projects outwards with respect to the lateral edge of opening 26, and comprises, at one end of opening 26, an end portion 29 detached from patch 27, defining a grip portion by which to tear open package 15, and sealed at a point B to the outer surface of lateral wall 20, so as not to interfere with parts of the packaging machine when forming; filling and sealing package 15.

In actual use, package 15 is opened by detaching grip portion 29 of tab 28 from wall 20 and pulling it along the perimeter of package 15, so as to tear off the part of patch 27 sealed to tab 28, and so free opening 26.

By virtue of the length of opening 26, end wall 17 is detached completely from lateral walls 19, 21 and 22, and can be rotated upwards about the edge still joining it to lateral wall 20, thus enabling the food product to be poured or spooned out easily.

The packaging material of package 15 may also be covered, on the outside and at opening 26, with a sheet element similar to sheet element 14 described previously with reference to FIG. 6.

The advantages of packages 1, 15 according to the present invention will be clear from the foregoing description.

In particular, as stated, packages 1, 15 can be opened completely at one end (8, 17) to enable the food product to be poured out easily, even in the case of a highly viscous product (yoghurt, cream, soup, etc.) or a solidified pourable food product (cheese, desserts).

Moreover, by virtue of the size of the open area of packages 1, 15, the food product can be spooned out easily or slid out in a solid block.

Clearly, changes may be made to packages 1, 15 as described and illustrated herein without, however, departing from the scope of the accompanying Claims.

In particular, openings 10, 26 of packages 1, 15 may be formed directly in the fibrous material layer or in the polypropylene layer, with a mineral inorganic filler, of the packaging material, before these layers are laminated with the other packaging material layers, which would then close openings 10, 26. In which case, patches 11, 27 would no longer be needed, and tabs 12, 28 would be sealed directly to the material covering openings 10, 26.

The invention claimed is:

1. A sealed package for pourable food products, formed from a multilayer packaging material; said package having an opening closed, on the inside of the package, by a sheet element; and a removable opening tab joined to said sheet element and covering said opening on the outside of said package; wherein said opening extends close to an end portion of said package and along at least half the perimeter of the package.

2. A package as claimed in claim 1, wherein said end portion is substantially wedge-shaped, and is defined by a transverse sealing band of the package; and in that said opening is elongated in a direction parallel to said transverse sealing band.

3. A package as claimed in claim 2, wherein being defined, on the opposite side to said wedge-shaped end portion, by a substantially rectangular, flat base wall, by two isosceles-trapezium-shaped first lateral walls projecting from respective opposite sides of said base wall and tapering towards the base wall, and by two triangular second lateral walls projecting from the other sides of said base wall and forming, with said first lateral walls, said wedge-shaped end portion; said opening extending along one of said first lateral walls.

4. A package as claimed in claim 1, wherein being in the form of a substantially parallelepiped-shaped box; said end portion being defined by an end wall of said package; and said opening extending along three consecutive lateral walls of the package.

5. A package as claimed in claim 4, wherein said opening extends, at each of said three consecutive lateral walls, parallel to the respective edge defined between the lateral wall and said end wall.

6. A package as claimed in claim 1, wherein said multilayer packaging material comprises at least one layer of thermoplastic material defining an inner surface of the package.

7. A package as claimed in claim 1, wherein said multilayer packaging material comprises at least one layer of polypropylene, in turn including a mineral inorganic filler.

8. A package as claimed in claim 6, wherein said sheet element is made of heat-seal material, is comparable in size with said opening, and is heat sealed to said layer of thermoplastic material of said multilayer packaging material about the opening.

9. A package as claimed in claim 8, wherein said tab is made of heat-seal material, and is heat sealed to said sheet element at said opening and along a sealing area defining a tear-off portion of and for tearing the sheet element as said tab is removed.

10. A package as claimed in claim 1, wherein comprising, about said opening, a further, multilayer, sheet element comprising at least a first and a second layer of plastic material sealed respectively to said tab and to the outside of the packaging material constituting the package; said first and said second layer of plastic material adhering to each other less firmly than to said tab and the packaging material of said package respectively.

11. A package as claimed in claim 10, wherein said first and said second layer of plastic material of said further sheet element are made of polypropylene and polyethylene respectively.

* * * * *